US010230196B2

(12) United States Patent
Phillips et al.

(10) Patent No.: US 10,230,196 B2
(45) Date of Patent: Mar. 12, 2019

(54) LATCH FOR ELECTRICAL CONNECTOR

(71) Applicant: Tyco Electronics Corporation, Berwyn, PA (US)

(72) Inventors: Michael John Phillips, Camp Hill, PA (US); Randall Robert Henry, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 18 days.

(21) Appl. No.: 14/712,998

(22) Filed: May 15, 2015

(65) Prior Publication Data

US 2016/0336685 A1 Nov. 17, 2016

(51) Int. Cl.
*H01R 13/627* (2006.01)
*H01R 13/633* (2006.01)

(52) U.S. Cl.
CPC ..... *H01R 13/6278* (2013.01); *H01R 13/6275* (2013.01); *H01R 13/6335* (2013.01)

(58) Field of Classification Search
CPC ..... H01R 13/6271; H01R 13/6275
USPC ..... 439/352, 353
See application file for complete search history.

(56) References Cited

U.S. PATENT DOCUMENTS 4,621,885 A 11/1986 Szczesny et al.
5,741,150 A 4/1998 Stinson et al.
7,064,959 B2 * 6/2006 Kim ..... G02B 6/3897 361/732
7,083,459 B1 8/2006 Wu et al.
7,322,845 B2 * 1/2008 Regnier ..... H01R 13/6335 439/352
7,402,070 B1 * 7/2008 Wu ..... H01R 13/635 439/152
7,422,457 B1 * 9/2008 Wu ..... G02B 6/4201 439/258
7,422,471 B1 * 9/2008 Wu ..... H01R 13/6658 439/485

(Continued)

FOREIGN PATENT DOCUMENTS

CN 201181767 Y 1/2009
CN 203135110 U 8/2013

(Continued)

OTHER PUBLICATIONS

International Search Report dated Jun. 15, 2016 received in International Application No. PCT/US2016/024613.

(Continued)

*Primary Examiner* — Tulsidas C Patel
*Assistant Examiner* — Marcus Harcum

(57) ABSTRACT

A latch for latching a connector to a device includes a body comprising a hub, an actuator extending from the hub, a latch pin extending from the hub and a return spring extending from the hub, the actuator and/or the latch pin. The latch pin is movable between a latched position and an unlatched position, wherein the latch pin is configured to latch the connector to the device when the latch pin is in the latched position. The actuator is configured such that movement of the actuator moves the latch pin between the latched position and the unlatched position. The return spring is configured to bias the latch pin to the latched position. The actuator, the latch pin and the return spring are integrally integrally formed as a single, unitary body.

20 Claims, 2 Drawing Sheets

(56) References Cited

U.S. PATENT DOCUMENTS

| | | | | |
|---|---|---|---|---|
| 7,429,185 | B1 * | 9/2008 | Wu | H01R 13/6275 439/372 |
| 7,507,103 | B1 * | 3/2009 | Phillips | G02B 6/4201 439/352 |
| 7,559,785 | B1 * | 7/2009 | Wu | H01R 13/6275 439/352 |
| 8,169,783 | B2 | 5/2012 | Phillips et al. | |
| 8,231,400 | B2 | 7/2012 | Phillips et al. | |
| 8,337,234 | B2 * | 12/2012 | Sasaki | H01R 13/6275 439/352 |
| 8,500,470 | B2 * | 8/2013 | Wang | G02B 6/4261 385/53 |
| 8,556,646 | B2 | 10/2013 | Kappla et al. | |
| 9,130,308 | B2 | 9/2015 | Wang et al. | |
| 2009/0209125 | A1 * | 8/2009 | Bright | H01R 13/6275 439/352 |
| 2011/0294334 | A1 * | 12/2011 | Phillips | G02B 6/4201 439/357 |
| 2012/0218720 | A1 * | 8/2012 | Wu | H01R 13/6275 361/740 |
| 2012/0329305 | A1 * | 12/2012 | Ritter | H01R 13/6335 439/350 |
| 2014/0193993 | A1 * | 7/2014 | Meng | H01R 13/633 439/352 |
| 2015/0249304 | A1 * | 9/2015 | Henry | H01R 13/6275 439/372 |
| 2016/0093978 | A1 * | 3/2016 | Phillips | H01R 13/62905 439/310 |

FOREIGN PATENT DOCUMENTS

| | | | |
|---|---|---|---|
| CN | 103688423 | A | 3/2014 |
| CN | 102812599 | A | 12/2015 |
| WO | 2006066046 | A1 | 6/2006 |

OTHER PUBLICATIONS

Search Report issued for Chinese application No. 201680027896.X dated Nov. 2, 2018.

* cited by examiner

LATCH FOR ELECTRICAL CONNECTOR

BACKGROUND OF THE INVENTION

The subject matter described and/or illustrated herein relates generally to latches for electrical connectors.

Electrical connectors often include latches for latching the electrical connector to another device, such as, but not limited to, another connector. For example, one particular example is a pluggable transceiver module that includes a latch used to secure the pluggable transceiver module in a cage receptacle.

Known latches for electrical connectors are not without disadvantages. For example, at least some known latches for electrical connectors are bulky and may occupy more space than is desired on a housing of the electrical connector. By occupying valuable housing space, such known latches may increase the overall size of the electrical connector, harm the form factor of the electrical connector, and/or harm the aesthetics of the electrical connector. Additionally, known latches include many component parts, such as separate actuators, latch pins and/or auto-return springs that bias the latch to the latched position. Providing multiple components increases manufacturing costs and complexity as well as assembly time and thus assembly cost. Furthermore, having multiple pieces causes reliability issues where the parts interact and when one or more of the parts fail.

A need remains for an electrical connector latch that is less costly and more reliable than known connector latches.

BRIEF DESCRIPTION OF THE INVENTION

In an embodiment, a latch is provided for latching a connector to a device. The latch includes a body comprising a hub, an actuator extending from the hub, a latch pin extending from the hub and a return spring extending from the hub, the actuator and/or the latch pin. The latch pin is movable between a latched position and an unlatched position, wherein the latch pin is configured to latch the connector to the device when the latch pin is in the latched position. The actuator is configured such that movement of the actuator moves the latch pin between the latched position and the unlatched position. The return spring is configured to bias the latch pin to the latched position. The actuator, the latch pin and the return spring are integrally formed as a single, unitary body.

In a further embodiment, an electrical connector is provided including a housing having a sidewall having a pocket, an electrical contact assembly held by the housing, and a latch received in the pocket in the sidewall of the housing for latching the electrical connector to a device. The latch includes a body comprising a hub, an actuator extending from the hub, a latch pin extending from the hub and a return spring extending from the hub, the actuator and/or the latch pin. The latch pin is movable between a latched position and an unlatched position, wherein the latch pin is configured to latch the connector to the device when the latch pin is in the latched position. The actuator is configured such that movement of the actuator moves the latch pin between the latched position and the unlatched position. The return spring is configured to bias the latch pin to the latched position. The actuator, the latch pin and the return spring are integrally formed as a single, unitary body.

DETAILED DESCRIPTION OF THE INVENTION

Figure 1:
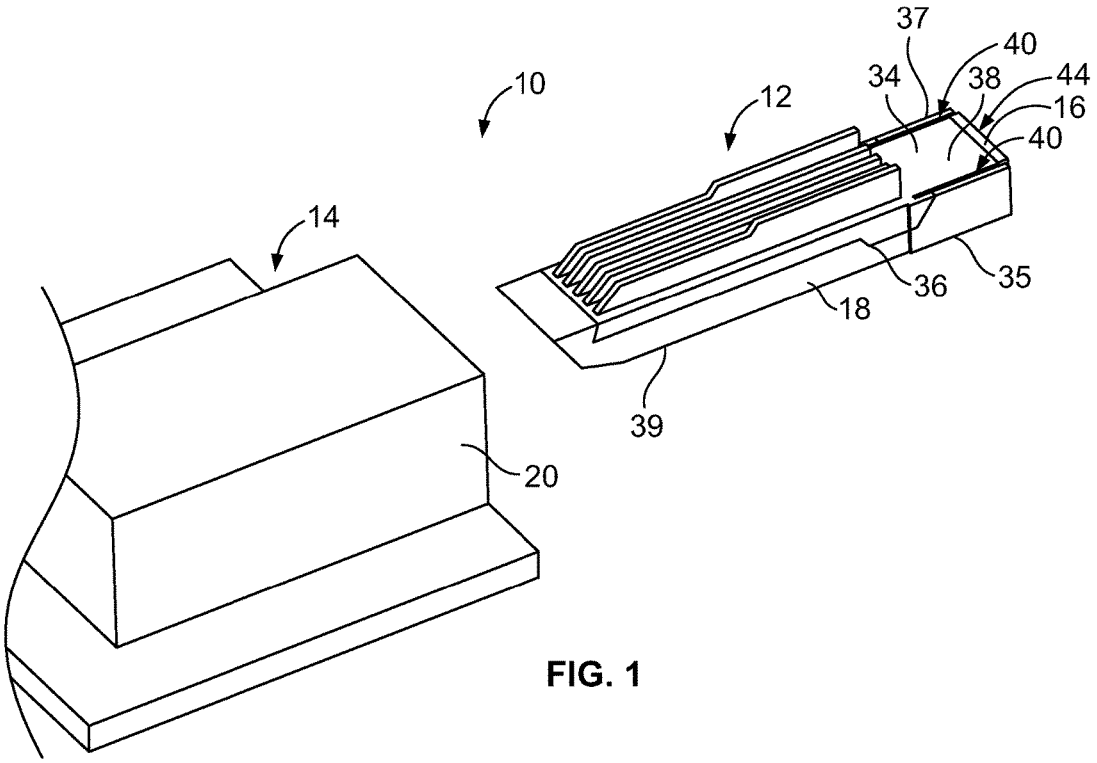
FIG. 1 is a top perspective view of an embodiment of an electrical connector assembly having electrical connector with a latch formed in accordance with an exemplary embodiment.
Figure 2:
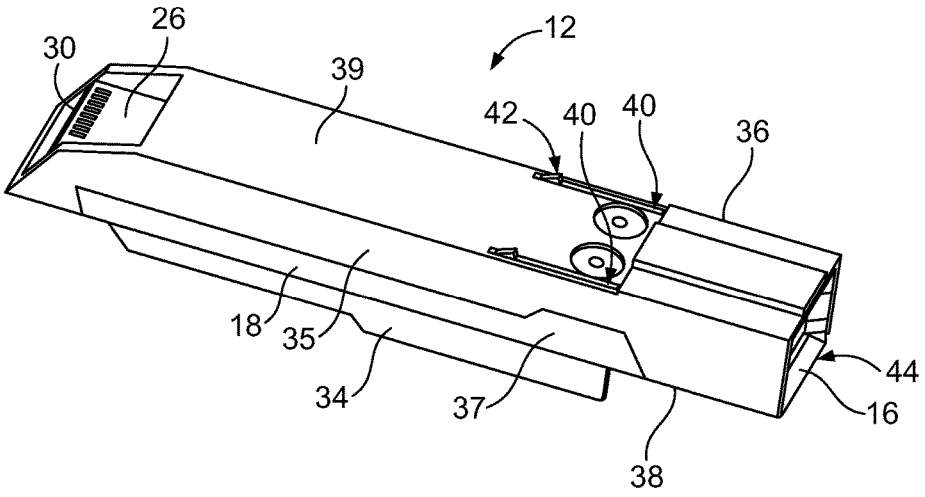
FIG. 2 is a bottom perspective view of the electrical connector.

FIG. 1 is a top perspective view of an embodiment of an electrical connector assembly 10 showing electrical connectors 12 and 14 that mate together to establish an electrical connection therebetween. FIG. 2 is a bottom perspective view of the electrical connector 12. The electrical connector 12 includes a latch 16 for latching the electrical connector 12 to the electrical connector 14. In the illustrated embodiment, the electrical connector 12 is a plug connector, such as a transceiver or pluggable module, and the electrical connector 14 is a receptacle connector that receives the plug module 12. Other types of electrical connectors 12, 14 may be used in alternative embodiments. Additionally, the latch 16 may be provided on the electrical connector 14 rather than the electrical connector 12 in alternative embodiments.

The electrical connectors 12 and 14 include housings 18, 20, respectively. The housing 18 may be a plug housing and the housing 20 may be a receptacle housing in various embodiments. For example, the housing 20 may define a cage member or transceiver cage defining a receptacle or port that receives the electrical connector 12. The housing 20 may be metal and provide electrical shielding, such as shielding from electromagnetic interference (EMI).

The electrical connector 12 includes an electrical contact assembly 26 (FIG. 2) held by the housing 18. The electrical contact assembly 26 is configured to be mated with a corresponding electrical connector assembly (not shown) of the electrical connector 14. For example, when the electrical connectors 12, 14 are mated together, the electrical contact assembly 26 is plugged into a communication connector of the electrical connector 14. The electrical contact assembly 26 may include any electrically conductive structure that enables the electrical connectors 12 and 14 to communicate data and/or electrical power therebetween. Examples of such electrically conductive structures include, but are not limited to, electrical signal contacts, electrical ground contacts, electrical power contacts, circuit boards, and/or the like. In the illustrated embodiment, the electrical contact assembly 26 includes electrical contacts 30 (FIG. 2) in the form of pads that are configured to engage in physical contact with corresponding electrical contacts of the electrical connector 14 to establish the electrical connection between the electrical connectors 12 and 14.

In the illustrated embodiment, the housing 18 includes an upper shell 34 and a lower shell 35 that are coupled together to form the housing 18. The housing 18 holds the electrical contact assembly 26, which is in the form of a circuit board in the illustrated embodiment. The housing 18 includes a pair of opposite sidewalls 36, 37 extending between an upper wall 38 and a lower wall 39. As can be seen in FIGS. 1 and 2, each of the sidewalls 36, 37 is defined by a portion of the upper shell 34 and a portion of the lower shell 35 in the illustrated embodiment. The sidewalls 36, 37 include pockets 40 that receive the latch 16. A portion of the latch 16, such as a latching end 42 of the latch 16, is exposed along the lower wall 39 for latching the latch 16 to the electrical connector 14. A portion of the latch 16, such as an actuation end 44 of the latch 16, is exposed along the upper wall 38 for actuating the latch 16. For example, the actuation end 44 may be pushed to actuate and/or pulled to actuate. The latch 16 is configured to pivot or otherwise move within the housing 18 between a latched position and an unlatched position as the latch 16 is actuated.

Figure 3:
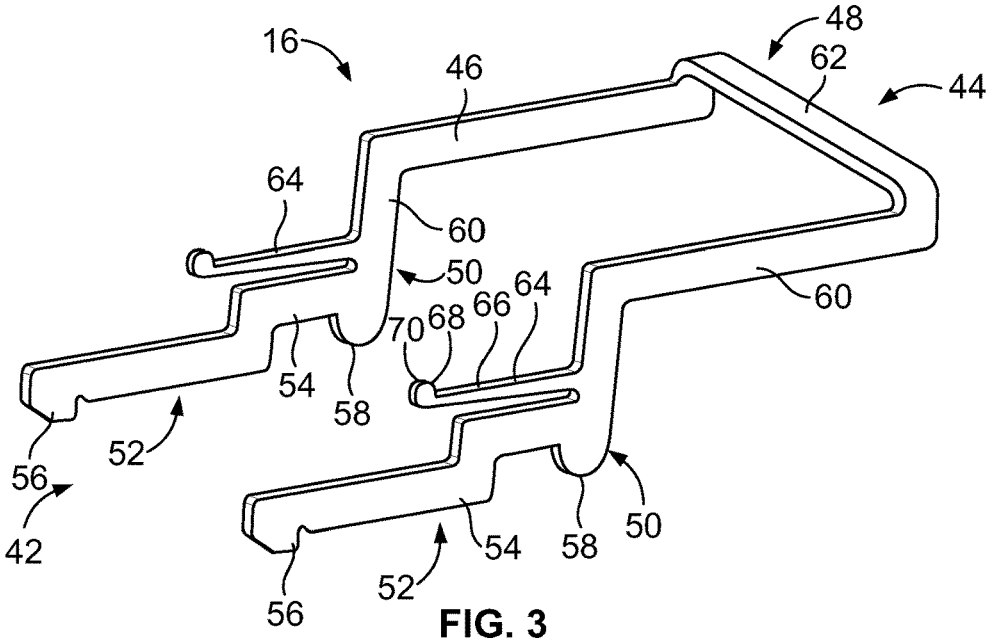
FIG. 3 is a perspective view of an embodiment of the latch of the electrical connector.

FIG. 3 is a perspective view of an embodiment of the latch 16. The latch 16 includes a body 46 extending between the latching end 42 and the actuation end 44. The latch 16 includes an actuator 48 at the actuation end 44 that is used to actuate and move the latch 16.

The latch 16 includes one or more hubs 50, which may be approximately centered between the latching end 42 and the actuation end 44. The actuator 48 extends from the hub(s) 50. In the illustrated embodiment, the latch 16 includes two hubs 50 and the actuator 48 is connected between the hubs 50 at the actuation end 44. Each of the hubs 50 may be referred to herein as a "first" and/or a "second" hub.

The latch 16 includes one or more latch pins 52 extending from the corresponding hub 50. The latch pins 52 extend to the latching end 42. In the illustrated embodiment, the latch 16 includes two latch pins 52. Each of the latch pins 52 may be referred to herein as a "first" and/or a "second" latch pin. Each latch pin 52 includes a corresponding latch arm 54 and latch member 56 at a distal end of the latch arm 54. The latch arms 54 may be jogged downward to lower the latch members 56, such as to allow the latch members 56 to extend below the housing 18 (shown in FIG. 2) for latching engagement with the electrical connector 14 (shown in FIG. 1). Optionally, the latch arms 54 may extend radially outward from the corresponding hub 50 and may be oriented generally horizontally. The latch members 56 extend outward (for example, downward) at the respective distal ends of the latch arms 54. Optionally, the latch members 56 may be positive latch members requiring the latch 16 to be positively released (for example, actuated) by a user. In alternative embodiments, the latch members 56 may be passive latch members that generally hold the electrical connector 12 in the latched position (for example, provide some resistance to pull-out of the electrical connector 12); however, the latch 16 may be unlatched or disengaged from the electrical connector 14 simply by pulling on the electrical connector 12. For example, the latch members 56 may be ramped such that pulling on the electrical connector 12 will cause the latch 16 to automatically unlatch. The ramp angle may be selected to control the pull-out force needed. The latch pins 52 are not limited to the geometry (e.g., shape, size, and/or the like) shown herein. Rather, each of the latch pins 52 may have any other geometry in addition or alternatively to the geometry shown herein.

As will be described below, the latch pins 52 are movable between a latched position and unlatched position. In the illustrated embodiment, the body 46 of the latch 16 is configured to rotate about an axis, such as a central axis, defined through the hubs 50. Outer edges of the hubs 50 may define pivot members 58 of the latch 16 to thereby rotate latch pins 52 (about the respective pivot members 58) between the latched position and the unlatched position. The outer edges may be curved to allow rotation of the latch 16 on the pivot members 58 (for example, on the outer edges of the hubs 50). The pivot members 58 cooperate with the housing 18 of the electrical connector 12 to enable the body 46 to rotate. Although shown as being located at approximately a center of the latch 16, the hubs 50 may be located at any other location in alternative embodiments. In the illustrated embodiment, the hubs 50 have curved protrusions that may be complementary with a corresponding curved pocket of the housing 18. Any other arrangements, configurations, geometries, and/or the like may be used in addition or alternative to the illustrated embodiments of the hubs 50 and pivot members 58.

In the illustrated embodiment, the actuator 48 extends from the hubs 50 in a generally opposite direction from the latch pins 54 (for example, the latch pins 54 extend forward and the actuator 48 extends rearward). The actuator 48 may extend in any other direction in alternative embodiments. The actuator 48 includes one or more actuator levers 60 extending from the corresponding hubs 50 and one or more actuator tabs 62 extending from the actuator levers 60. Each of the actuator levers 60 may be referred to herein as a "first" and/or a "second" actuator lever. In the illustrated embodiment, a single actuator tab 62 connects the pair of actuator levers 60. The actuator tab 62 is provided at the actuation end 44. At least a portion of the actuator tab 62 may be exposed at an exterior of the housing 18 for actuation by a user. In the illustrated embodiment, each actuator lever 60 has a proximal or vertical leg and a distal or horizontal leg oriented approximately perpendicular to the vertical leg. The legs provide moment arms from the hubs 50 for actuation and rotation of the latch 16. The actuator levers 60 may have other shapes in alternative embodiments.

The latch 16 includes one or more return springs 64 extending from at least one of the actuator 48, the hubs 50, and/or the latch pins 52. In the illustrated embodiment, the return springs extend from the actuator 48 along the vertical leg of the actuator levers 60; however other locations are possible in alternative embodiments. The return springs 64 are configured to operatively engage the housing 18 to bias the latch 16 to the latched position, as will be described below. The latch 16 may include any number of the return springs 64. In the illustrated embodiment, the latch 16 includes two return springs.

Each return spring 64 includes a spring body 66 and a spring finger 68 that extends outward from the spring body 66. Other shapes are possible in alternative embodiments. The spring body 66 is flexible and may be elastically deformed as the latch 16 is pivoted from the latched position to the unlatched position. As will be described below, an engagement surface 70 of the spring finger 68 is configured to engage in physical contact with the housing 18 and the spring body 66 may be pre-loaded against the housing 18 to bias the latch pin 52 to the latched position. Any other geometry, configuration, arrangement, type of spring, and/or the like may be used in addition or alternatively to the illustrated embodiment of the return spring 64.

The various components of the body 46 of the latch 16 are integrally formed as a single, unitary body. For example, the components of the body 46 may be fabricated from the same sheet of metal material as a continuous structure such that the body 46 is a single, unitary body. For example, the actuator 48, the hubs 50, the latch pins 52 and the return springs 64 are integrally fabricated from the same sheet of material as a continuous structure such that the body 46 is a single, unitary body. One example of a process for integrally fabricating the various components of the body 46 from the same sheet of material as a continuous structure includes cutting the body 46 from a sheet of material and forming the cut structure into the finished shape of the body 46 shown herein, which may be referred to herein as a "cut and formed" body. Any cutting process(es) may be used to fabricate the body 46 as a cut and formed body, such as, but not limited to, stamping, laser cutting, water cutting, plasma cutting, cutting using a cutting tool (e.g., a saw, a blade, and/or the like), and/or the like. Moreover, any forming process(es) may be used to fabricate the body 46 as a cut and formed body, such as, but not limited to, compressive forming, tensile forming, combined compressive and tensile forming, bending, shearing, stamping, die forming, forging, indenting, rolling, stretching, expanding, recessing, deep drawing, spinning, flange forming, upset bulging, and/or the like. In some embodiments, the body 46 is a stamped and formed body that is stamped from a sheet of material. In such embodiments wherein the body 46 is a stamped and formed body, any other type and/or number of forming methods optionally may be used in addition to the stamping process(es) to fabricate the body 46 as a stamped and formed body. In other various embodiments, the body 46 may be a molded or die cast body. The body 46 may be manufactured from a plastic material in some embodiments.

Integrally fabricating the various components of the body 46 from the same sheet of material as a continuous structure such that the body 46 is a single, unitary body, for example using a cutting and forming process, may reduce a cost of the electrical connector 12, for example as compared to at least some known electrical connectors that include latches. For example, integrally fabricating the return springs 64 with the other components of the body 46 reduces the number of parts for manufacture and assembly. Having the return springs 64 integrally fabricated with the other components of the body 46 reduces assembly costs and complexity. Having the return springs 64 integrally fabricated with the other components of the body 46 reduces operation complexity and chance for malfunction, such as from a situation in which a separate return spring may become mis-aligned with the latch leading to malfunction.

Figure 4:
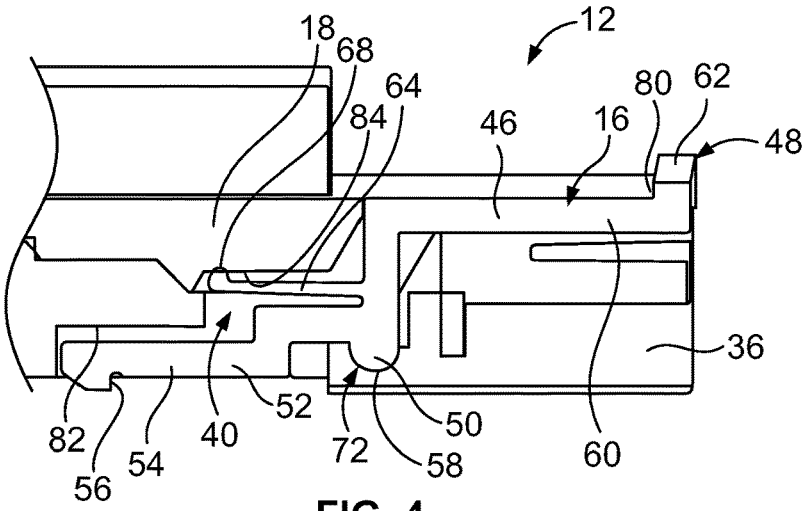
FIG. 4 is a partially cut-away view of the electrical connector illustrating the latch in a latched position.
Figure 5:
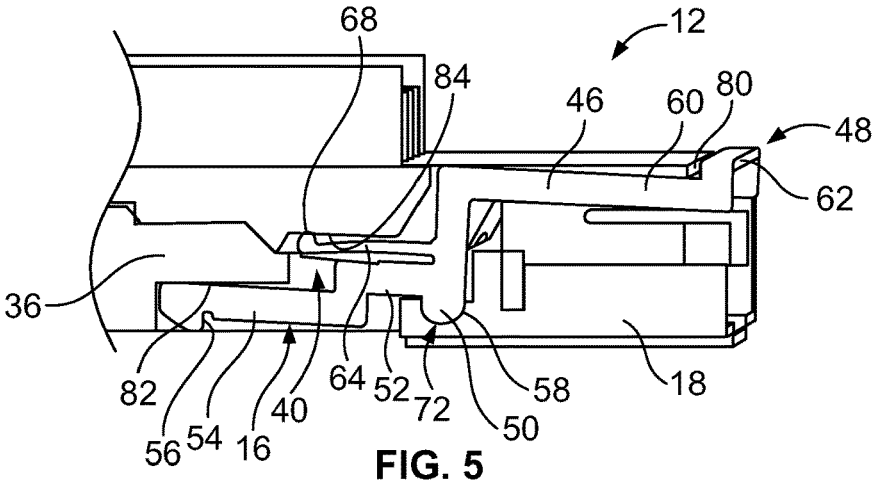
FIG. 5 is a partially cut-away view of the electrical connector illustrating the latch in an unlatched position.

FIG. 4 is a partially cut-away view of the electrical connector 12 illustrating the latch 16 in a latched position. FIG. 5 is a partially cut-away view of the electrical connector 12 illustrating the latch 16 in an unlatched position. The housing 18 has been cut-away to illustrate a cross-section of the sidewall 36. The sidewall 36 includes one or more internal cavities defining the pocket 40. The sidewall 36 includes a cradle 72 that receives a portion of the hub 50, including the pivot member 58 to enable the body 46 of the latch 16 to rotate about the pivot member 58. The cradle 72 is complementary in shape with the pivot member 58 for receiving the pivot member 58 therein. Any other arrangements, configurations, geometries, and/or the like may be used in addition or alternative to the illustrated embodiment of the cradle 72.

The body 46 is held within the internal cavities of the pocket 40. The body 46 can be considered to be embedded within the sidewall 36 because the body 46 is interior of the sidewall 36. Embedding the latch pin 52, actuator lever 60 and/or the return spring 64 within the sidewall 36 may reduce the size of the electrical connector 12, for example as compared to at least some known electrical connectors that include latches. Moreover, embedding the latch pin 52, actuator lever 60 and/or the return spring 64 within the sidewall 36 may improve the form factor of the electrical connector 12 as compared to at least some known electrical connectors that include latches. For example, embedding the latch pin 52, actuator lever 60 and/or the return spring 64 within the sidewall 36 may prevent or reduce the occurrence of snagging the electrical connector 12 on other objects, structures, and/or the like. Embedding the latch pin 52, actuator lever 60 and/or the return spring 64 within the sidewall 36 may improve the aesthetics of the electrical connector 12 as compared to at least some known electrical connectors that include latches.

The sidewall 36 includes a number of stop surfaces that stop or limit movement of the latch 16 in the pocket 40. For example, the housing 18 includes an actuator stop surface 80, a latch pin stop surface 82 and a return spring stop surface 84; however the housing 18 may include other stop surfaces in other embodiments. The actuator stop surface 80 defines a limit used to stop or hold the latch 16 in the latched position. The latch pin stop surface 82 defines a limit used to stop or hold the latch 16 in the unlatched position.

The latch 16 is shown in the latched position in FIG. 4, with the return spring 64 in the natural resting position thereof. As noted above, the return spring 64 may be pre-loaded against the return spring stop surface 84 of the housing 18 to hold the latch 16 in the latched position. When the return spring 64 is in the natural resting position, the spring finger 68 is engaged in physical contact with the housing 18 such that the return spring 64 biases the latch 16 to the latched position. In the latched position, the actuator tab 62 abuts against the actuator stop surface 80, which stops further rotation of the latch 16 (for example, in a counter-clockwise direction) at the latched position. In other embodiments, a different stop surface may stop rotation of the latch 16, such as a stop surface under the latch arm 54 and forward of the hub 50.

To move the latch 16 from the latched position (FIG. 4) to the unlatched position (FIG. 5), the actuator tab 62 is pushed downward and/or pulled rearward such that the latch 16 rotates about the pivot member 58, which rotates the latch pin 52 against the bias of the return spring 64 from the latched position to the unlatched position. In the unlatched position, the latch arm 54 and/or the latch member 56 abuts against the latch pin stop surface 82, which stops further rotation of the latch 16 (for example, in a clockwise direction) at the unlatched position. In other embodiments, a different stop surface may stop rotation of the latch 16, such as a stop surface behind the hub 50 and/or under the actuator lever 60.

In use, the latch 16 can be unlatched using the actuator 48 to remove the electrical connector 12 from the housing 20 of the electrical connector 14 (both shown in FIG. 1) and thereby de-mate the electrical connector 12 from the electrical connector 14. To plug the electrical connector 12 into the housing 20, the actuator 48 can be held against the bias of the return spring 64 to retain the latch pins 52 in the unlatched position as the electrical connector 12 is inserted into the housing 20. Additionally or alternatively, engagement in physical contact with the housing 20 as the electrical connector 12 is loaded into the receptacle of the housing 20 may cause movement of the latch pins 52 away from the latched position, against the bias of the return springs 64, without the need to press down on the actuator 48. Once the electrical connector 12 has been inserted sufficiently deep into the housing 20, the return springs 64 force the latch pins 52 into corresponding latch openings (not shown) in the housing 20. Optionally, the latch pins 52 include ramp surfaces at the front end to facilitate sliding along the wall of the housing 20 and camming movement of the latch 16 to the unlatched position.

Although shown as being used with the particular electrical connectors 12, 14, the latch embodiments shown and/or described herein may be used with any other type of electrical connector. The latch embodiments described and/or illustrated herein may provide a relatively robust, reliable, and/or cost effective latch that is biased to the latched position in a minimal envelope.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A latch for latching a connector to a device, the latch comprising:

a body comprising a hub, an actuator extending from the hub, a latch pin extending from the hub and a return spring extending from at least one of the hub, the actuator or the latch pin, the return spring being located in a position directly vertically above the latch pin, the latch pin being movable between a latched position and an unlatched position, wherein the latch pin includes a latch member having an engagement surface configured to engage and latch the connector to the device when the latch pin is in the latched position, the actuator being configured such that movement of the actuator moves the latch pin between the latched position and the unlatched position, the return spring being configured to bias the latch pin to the latched position; and wherein the actuator, the latch pin, the latch member and the return spring are integrally formed as a single, unitary body.

2. The latch of claim 1, wherein the body is stamped and formed from a sheet of metal material.

3. The latch of claim 1, wherein the return spring extends from the actuator from a position of the actuator adjacent to the hub, the return spring extends in a direction generally parallel to and spaced apart from the latch pin directly vertically above the latch pin.

4. The latch of claim 1, wherein the return spring is resiliently deformed as the actuator is actuated causing the latch pin to move from the latched position to the unlatched position, the return spring causing the latch pin to return to the latched position when the actuator is released.

5. The latch of claim 1, wherein the body includes the actuator extending from a top of the hub and the latch pin extending from a front of the hub generally perpendicular to the actuator, movement of the actuator is configured to cause the latch pin to pivot about the hub.

6. The latch of claim 1, wherein the hub comprises a pivot member, and wherein an actuating force on the actuator causes the hub to rotate on the pivot member to move the latch pin between the latched position and the unlatched position.

7. The latch of claim 1, wherein the hub is a first hub and the latch pin is a first latch pin, the body further comprising a second hub and a second latch pin extending from the second hub, the actuator extending from the second hub.

8. The latch of claim 7, wherein the return spring is a first return spring, the body further comprising a second return spring extending from at least one of the second hub, the actuator and the second latch pin.

9. The latch of claim 7, wherein the actuator comprises first and second actuator levers extending from the first and second hubs, respectively, and wherein the actuator comprises an actuator tab that extends between the first and second actuator levers, the actuator tab being configured to receive an actuating force to rotate the body about the first and second hubs.

10. The latch of claim 1, wherein the actuator extends from a first side of the hub and the latch pin extends from a second side of the hub generally opposite the first side, the return spring being adjacent the hub.

11. The latch of claim 1, wherein the latch pin includes a latch arm and a latch member at a distal end of the latch arm, the return spring extending parallel to and above the latch arm, the hub extending below the latch arm to define a pivot member of the body.

12. An electrical connector comprising:

a housing having a sidewall having a pocket;

an electrical contact assembly held by the housing; and a latch rotatably received in the pocket in the sidewall of the housing for latching the electrical connector to a device, the latch comprising:

a body comprising a hub, an actuator extending from the hub, a latch pin extending from the hub and a return spring extending from at least one of the hub, the body being rotated about the hub, the actuator or the latch pin immediately adjacent to the hub, the actuator being exposed at an exterior of the housing for actuation of the latch, the latch pin being rotated along a non-linear path with the hub between a latched position and an unlatched position, wherein the latch pin includes a latch member rotated with the latch pin, the latch member having an engagement surface extending below and being exposed at the exterior of the housing, the engagement surface of the latch member engaging the device to latch the connector to the device when the latch pin is in the latched position, the actuator being configured such that movement of the actuator moves the latch pin between the latched position and the unlatched position, the return spring being configured to bias the latch pin to the latched position, wherein the actuator, the latch pin, the latch member and the return spring are integrally formed as a single, unitary body.

13. The electrical connector of claim 12, wherein the housing comprises an upper shell and a lower shell, the body of the latch being captured between the upper shell and the lower shell, the upper shell having stop surfaces that stop movement of the latch in the latched position and stop surfaces that stop movement of the latch in the unlatched position, the hub being pivoted on the lower shell, the return spring being biased against the upper shell.

14. The electrical connector of claim 12, wherein the return spring extends from the actuator in a position above the latch pin and generally parallel to and spaced apart from the latch pin.

15. The electrical connector of claim 12, wherein the return spring is resiliently deformed as the actuator is actuated causing the latch pin to move from the latched position to the unlatched position, the return spring causing the latch pin to return to the latched position when the actuator is released.

16. The electrical connector of claim 12, wherein the hub comprises a pivot member engaging and pivoting about the housing, and wherein an actuating force on the actuator causes the hub to rotate on the pivot member to move the latch pin between the latched position and the unlatched position.

17. The electrical connector of claim 12, wherein the hub is a first hub and the latch pin is a first latch pin, the body further comprising a second hub and a second latch pin extending from the second hub, the actuator extending from the second hub, the second hub and the second latch pin being received in a pocket in a second sidewall of the housing.

18. The electrical connector of claim 17, wherein the return spring is a first return spring, the body further comprising a second return spring extending from at least one of the second hub, the actuator and the second latch pin.

19. The electrical connector of claim 17, wherein the actuator comprises first and second actuator levers extending from the first and second hubs, respectively, and wherein the actuator comprises an actuator tab that extends between the first and second actuator levers, the actuator tab being configured to receive an actuating force to rotate the body about the first and second hubs.

20. The electrical connector of claim 12, wherein the latch pin includes a latch arm and a latch member at a distal end of the latch arm, the return spring extending parallel to and above the latch arm, the hub extending below the latch arm to define a pivot member of the body.

* * * * *